US011122843B2

(12) United States Patent
Emery

(10) Patent No.: US 11,122,843 B2
(45) Date of Patent: Sep. 21, 2021

(54) SYSTEMS AND METHODS FOR RELIEF FROM FACE MASK EAR LOOPS

(71) Applicant: Benjamin Emery, Casper, WY (US)

(72) Inventor: Benjamin Emery, Casper, WY (US)

( * ) Notice: Subject to any disclaimer, the term of this patent is extended or adjusted under 35 U.S.C. 154(b) by 145 days.

(21) Appl. No.: 16/449,024

(22) Filed: Jun. 21, 2019

(65) Prior Publication Data

US 2020/0229520 A1 Jul. 23, 2020

Related U.S. Application Data

(60) Provisional application No. 62/793,741, filed on Jan. 17, 2019.

(51) Int. Cl.
*A41D 13/11* (2006.01)

(52) U.S. Cl.
CPC ..... *A41D 13/1161* (2013.01)

(58) Field of Classification Search
CPC .. A41D 13/11–1192; A62B 18/00–088; A62B 7/00–14; A62B 9/00; A61M 16/06–0694
See application file for complete search history.

(56) References Cited

U.S. PATENT DOCUMENTS 2,012,505 A 8/1935 Goldsmith
2,248,477 A * 7/1941 Lombard ..... A61M 16/0683 128/205.25
2,634,725 A 4/1953 Lo Presti
3,013,556 A * 12/1961 Galleher, Jr. ..... A62B 18/084 128/207.11
3,971,369 A 7/1976 Aspelin et al.
4,323,063 A 4/1982 Fisichella
4,662,005 A 5/1987 Grier-Idris
4,688,566 A 8/1987 Boyce
5,237,986 A * 8/1993 Seppala ..... A41D 13/1146 128/201.23
5,322,061 A 6/1994 Brunson
5,374,458 A 12/1994 Burgio
5,699,791 A 12/1997 Sukiennik et al.
(Continued)

FOREIGN PATENT DOCUMENTS

WO WO 2016/047579 A1 * 3/2016
WO WO-2016047579 A1 * 3/2016 ..... A62B 18/02

OTHER PUBLICATIONS

Benchmark Products, Fluidshield PFR95 N95 Particulate Filter Respirator & Surgical Mask. http://www.benchmarkproducts.com/products/fluidshield-pfr95-n95-particulate-filter-respirator-surgical-mask_p31.html. Accessed Apr. 3, 2018. 3 pages.
(Continued)

*Primary Examiner* — Michelle J Lee
(74) *Attorney, Agent, or Firm* — Santangelo Law Offices, P.C.

(57) ABSTRACT

Embodiments of the present invention may make wearing a surgical mask having ear loops more comfortable for a wearer. It may include a head band that may connect to the two ear loops of a mask. A head band may include a strap and a connector near each end of a strap which may be removably or even permanently attached to a surgical mask. A head band may go around the back of the head perhaps so that a pull from the mask may occur on the back of the head and not on the ears and may avoid the ear pull in a forward and downward direction.

6 Claims, 7 Drawing Sheets

(56) References Cited

U.S. PATENT DOCUMENTS

| | | | | |
|---|---|---|---|---|
| 5,724,677 | A | 3/1998 | Bryant et al. | |
| 5,735,270 | A | 4/1998 | Bayer | |
| 6,148,817 | A | 11/2000 | Bryan et al. | |
| 7,044,131 | B2 | 5/2006 | Griesbach, III et al. | |
| 7,077,139 | B2 | 7/2006 | Amante et al. | |
| 7,296,575 | B1 * | 11/2007 | Radney | A61M 16/06 128/207.11 |
| 8,196,583 | B2 | 6/2012 | Radney | |
| 8,695,603 | B2 | 4/2014 | Harold et al. | |
| 2004/0216744 | A1 | 11/2004 | Amante et al. | |
| 2006/0130841 | A1 | 6/2006 | Spence et al. | |
| 2006/0283454 | A1 | 12/2006 | Delaney et al. | |
| 2008/0105261 | A1 | 5/2008 | Harold et al. | |
| 2011/0180078 | A1 | 7/2011 | McKinley | |
| 2011/0197341 | A1 * | 8/2011 | Formica | A61M 16/0633 2/209.3 |
| 2012/0000473 | A1 | 1/2012 | Shigematsu et al. | |
| 2013/0146064 | A1 * | 6/2013 | Dryden | A61M 16/0683 128/207.18 |
| 2013/0233325 | A1 | 9/2013 | Smaldone | |
| 2015/0216241 | A1 * | 8/2015 | Lee | A41D 13/1192 128/863 |

OTHER PUBLICATIONS

Lab Masks, Cleanroom Facemask with Headband. http://www.valutek.com/Polypropylene-Facemask-Ear-Loop-and-Headband-3-Ply-7x3-5-White. Accessed Apr. 3, 2018. 3 pages.

Smartpractice, Critical Cover PFL with Magic Arch Single Band Masks. https://www.smartpractice.com/shop/wa/style?id=S16503&m=SPC&cid=509630. Accessed Apr. 3, 2018. 2 pages.

Young's Dental, Surgical Molded Face Masks with Elastic Headband. http://www.youngsdental.com/product_info.php?products_id=178 Accessed Apr. 3, 2018. 2 pages.

U.S. Appl. No. 62/793,741, filed Jan. 17, 2019, Inventor Benjamin Emery.

* cited by examiner

SYSTEMS AND METHODS FOR RELIEF FROM FACE MASK EAR LOOPS

This application is a U.S. nonprovisional application claiming priority to and the benefit of U.S. Provisional Application No. 62/793,741, filed Jan. 17, 2019, hereby incorporated by reference herein in its entirety.

FIELD OF THE INVENTION

Generally, embodiments of the present invention may provide a systems and methods to attach a face mask to a user's face. This may include a head band which may be used with any face mask perhaps with or without ear loops perhaps to increase comfort for the person wearing the mask. Specifically, embodiments of the present invention may focus on utilizing items such as a head band to connect the two ear loops of a surgical mask perhaps in a manner such that the head band may wrap around the back of a user's head.

BACKGROUND

Perhaps one of the more significant problems that people encounter when wearing face masks with ear loops may be the uncomfortable nature of wearing them. When a person wears a face mask with ear loops, the ears may be pulled in a forward direction such that a mask may exert sufficient force on the ears and may make the face mask uncomfortable to wear. These forces may pull the ears forward, sometimes even folding them over. Often times the ear loops may gouge into the skin on the back of the ear perhaps due to tension. Furthermore, when the person needs to take the mask off the face, she may either need to hook it under the chin or discard it completely. If the person wishes to hook the mask under the chin, the ears may nearly fold in half with pressure and may strain the ears from the ear loops. This may cause a significant amount of discomfort. If the person wishes to remove the mask from the face completely, the mask may need to be discarded, thus possibly increasing consumables and even overhead expenses.

SUMMARY OF THE INVENTION

Accordingly, the invention provides various embodiments that can be implemented either alone or in combinations to achieve a variety of goals. Some of these goals include, but are not limited to, providing systems and methods using face masks that may be available on the market and adding a head band to the mask. The desire for a comfortable face mask to be worn may have been a concern for many years and a head band attachment may make the mask more comfortable to wear by a consumer.

Another goal of the present invention may include providing advantages of a mask head band throughout the distribution cycle. To the manufacturer, the current masks on the market can be used so that reconfiguration of the production machines and facilities may not be necessary. To the consumer, connecting two ear loops of a mask with a head band that may go behind the head may increase comfort while wearing the mask. There may not be any other face masks to date that provide this comfort advantage for a mask-wearer.

Naturally, further objects, goals and embodiments of the inventions are disclosed throughout other areas of the specification, claims, and drawings.

DETAILED DESCRIPTION OF THE PREFERRED EMBODIMENTS

It should be understood that the present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments is not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Embodiments of the present invention may provide face mask relief systems and methods of adjusting a face mask. This may include, but is not limited to, a face mask relief system comprising a head band having a strap and a connector near each end of said strap; wherein said head band is configured to attach to each of two ear loops of a surgical mask. It may also include providing a surgical mask comprising a mask portion that covers a nose and mouth of a user; and two ear loops, each of said ear loops located opposite of each other on opposite sides of said mask portion; attaching a head band to each of said ear loops of said surgical mask; placing said surgical mask on a face of said user and over said nose and mouth of said user; pulling said head band over a head of said user; avoiding placing said ear loops around each of ear of said user; placing said head band around a back of said head of said user; and perhaps even securing said surgical mask to said user's face.

Figure 1:
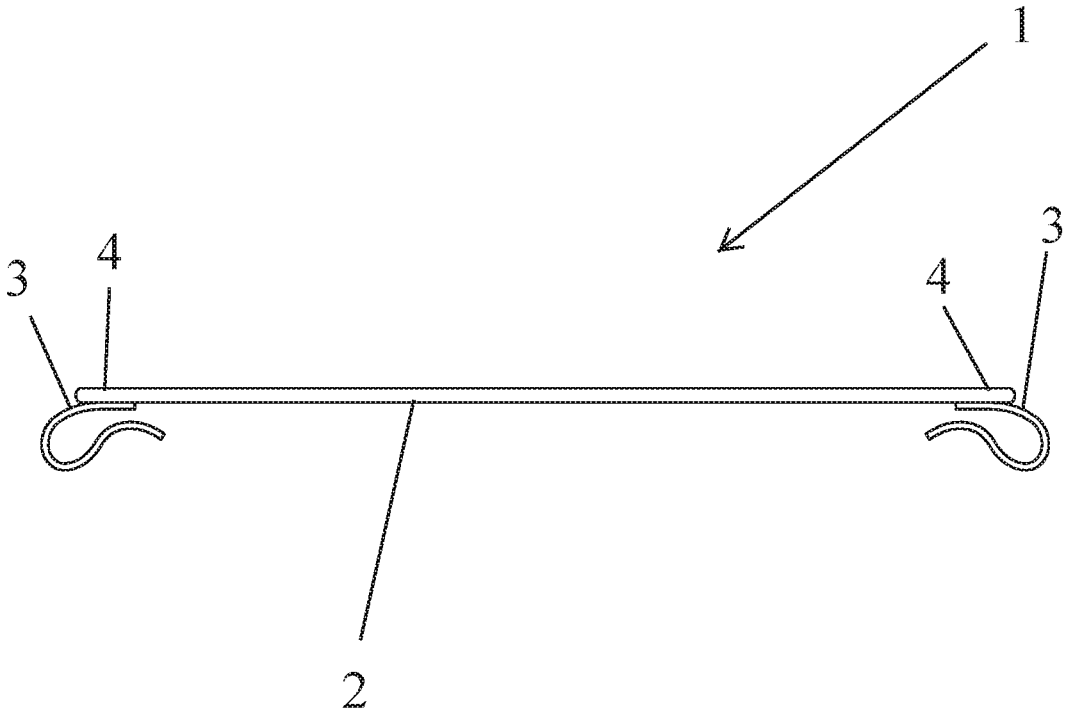
FIG. 1 shows an example of a head band in accordance with embodiments of the present invention.

As may be understood in FIG. 1, a head band (1) may have a strap (2) and a connector (3) perhaps near each end (4) of a strap and a head band may be configured to attach to each of two ear loops (5) of a surgical mask (6). A head band (1) may be stretchable and may even be reusable with new surgical masks. A strap (2) of a head band can be made from many different materials, such as but not limited to disposable materials, non-disposable materials, static filaments, elastic fibers, reusable materials, neoprene, silicone, any combination thereof, or the like. In some embodiments, the strap may be made from the same material as the existing ear loops on the face mask. A strap may be long enough to fit comfortably behind the head of the mask wearer but may also be short enough so that there may not be slack in the mask when being worn. The thickness of a strap could vary depending on the material being used or the desired comfort or the like.

Figure 2:
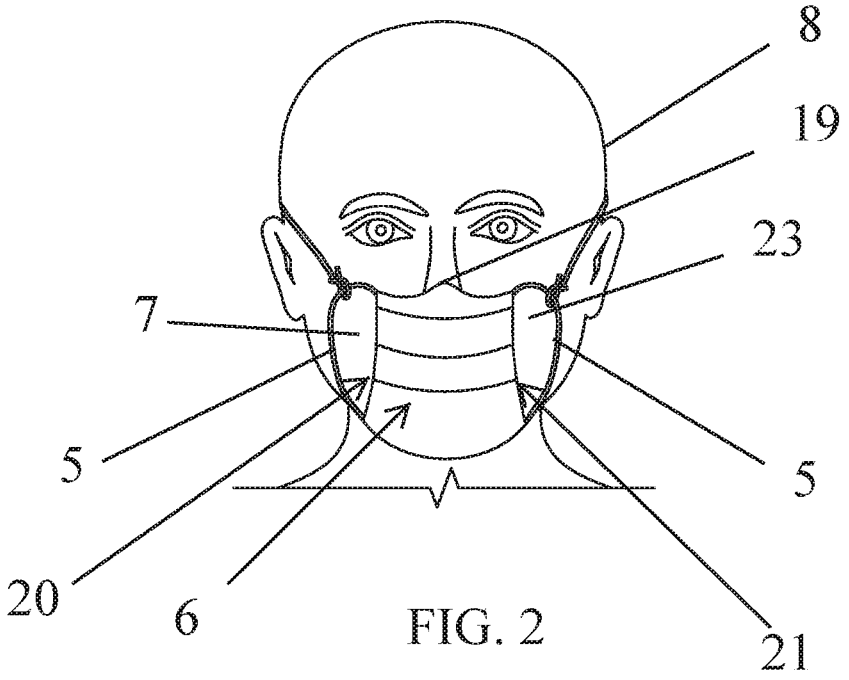
FIG. 2 shows an example of a front view of a user wearing a surgical mask connected with a head band in accordance with embodiments of the present invention.

A surgical mask (6) may have a mask portion (18) that may cover a nose (19) and mouth (not shown) of a user (10) and perhaps even two ear loops (5), each of the ear loops may be located opposite of each other on opposite sides of a mask portion (18). FIG. 2 shown an example of a first side (20) of a mask portion and an opposite second side (21) of a mask portion (18).

Figure 4:
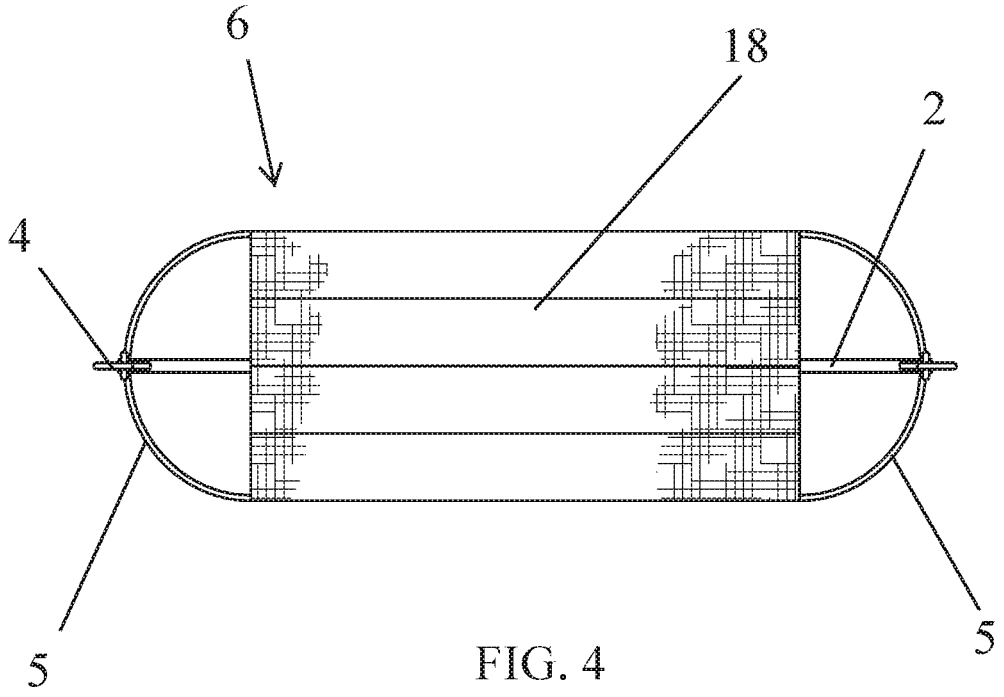
FIG. 4 shows an example of a front view of a surgical mask connected to a head band in accordance with embodiments of the present invention.
Figure 5:
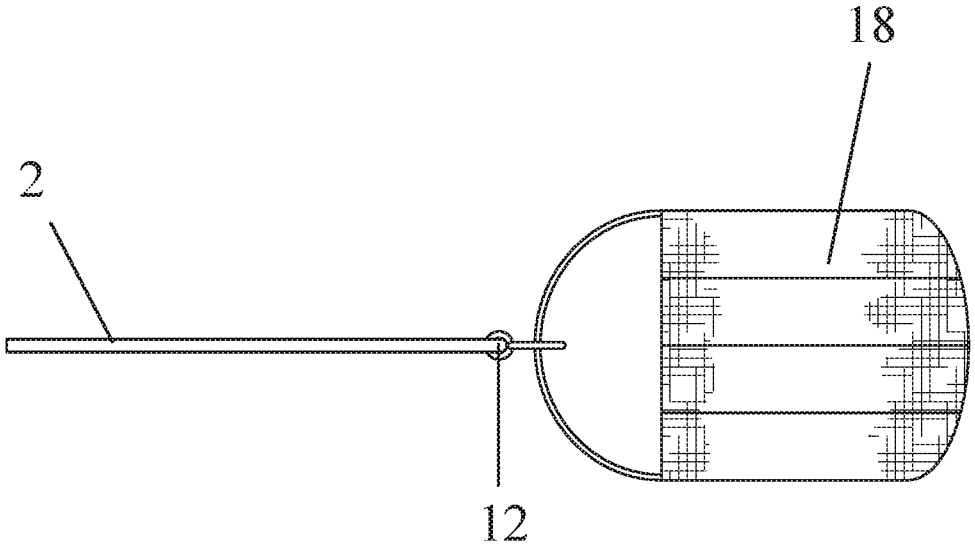
FIG. 5 shows an example of a side view of a surgical mask connected to a head band in accordance with embodiments of the present invention.
Figure 6:
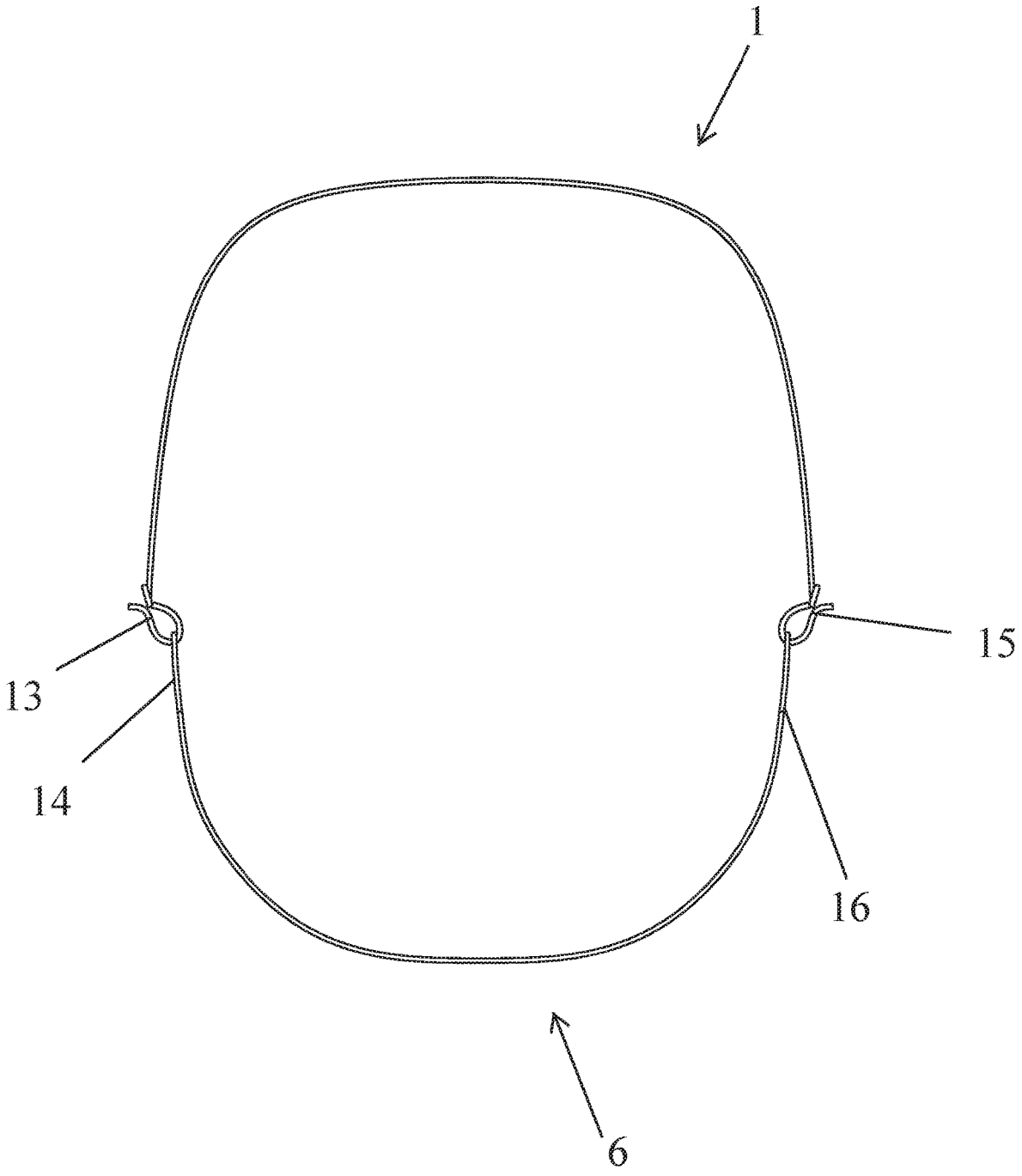
FIG. 6 shows an example of top view of a surgical mask connected to a head band in accordance with embodiments of the present invention.

A head band may be attached to each of the ear loops of a surgical mask as may be understood in FIGS. 4, 5, and 6. Two connectors (3) may be located at opposite ends (4) of a strap as shown in FIG. 1 which may allow the head band to attach to a face mask or perhaps even to each ear loop of a surgical mask. A connector may be any type of fastening device such as but not limited to a hook, omega hook, hook and loop fastener, glue, welded joint, adhesive, button, snap, any combination thereof, or the like. A connector (3) may be made of a material such as but not limited to plastic, metal, silicone, fabric, rubber, metal coated in silicone, metal coated in rubber, metal coated in fabric, malleable material, any combination thereof, or the like. A connector may be prefabricated or even made from a malleable material perhaps to be pinch closed by the wearer. The hooks can be fabricated using any technique, including but not limited to die cutting. In a non-limiting example, hooks can be affixed to each end of a strap perhaps in a way that may allow the opening end of the hooks to face each other. Perhaps by attaching the hooks to the strap in this fashion, the head band may be able to hook onto each of the ear loops of a mask perhaps so the head band can be pulled away from the mask and then over the head of the mask wearer. Connectors can be affixed to the strap or may be included as one piece using any technique. Connectors may be permanently affixed to a strap perhaps with an affixment (12) such as but not limited to ultrasonic welding, adhesive, stamping, sewing, glue, any combination thereof, or the like. The hooks can be made of any material including, but not limited to, plastic, rubber, fabric, metal, or the like.

Connectors can be either affixed to each ear loop or can be looped through the ear loops and then affixed to itself, which may essentially double the head band itself over. A head band may be attached as a single connector to each ear loop or it may even be a double connector. For example, a first connector (13) may be configured to attach to a first ear loop (14) and a second connector (15) may be configured to attach to a second ear loop (16) as may be understood in FIG. 6. A user may attach a first connector (13) of the connectors to a first ear loop (14) of the ear loops; and may attach a second connector (15) of the connectors to a second ear loop (16) of the ear loops.

Figure 7:
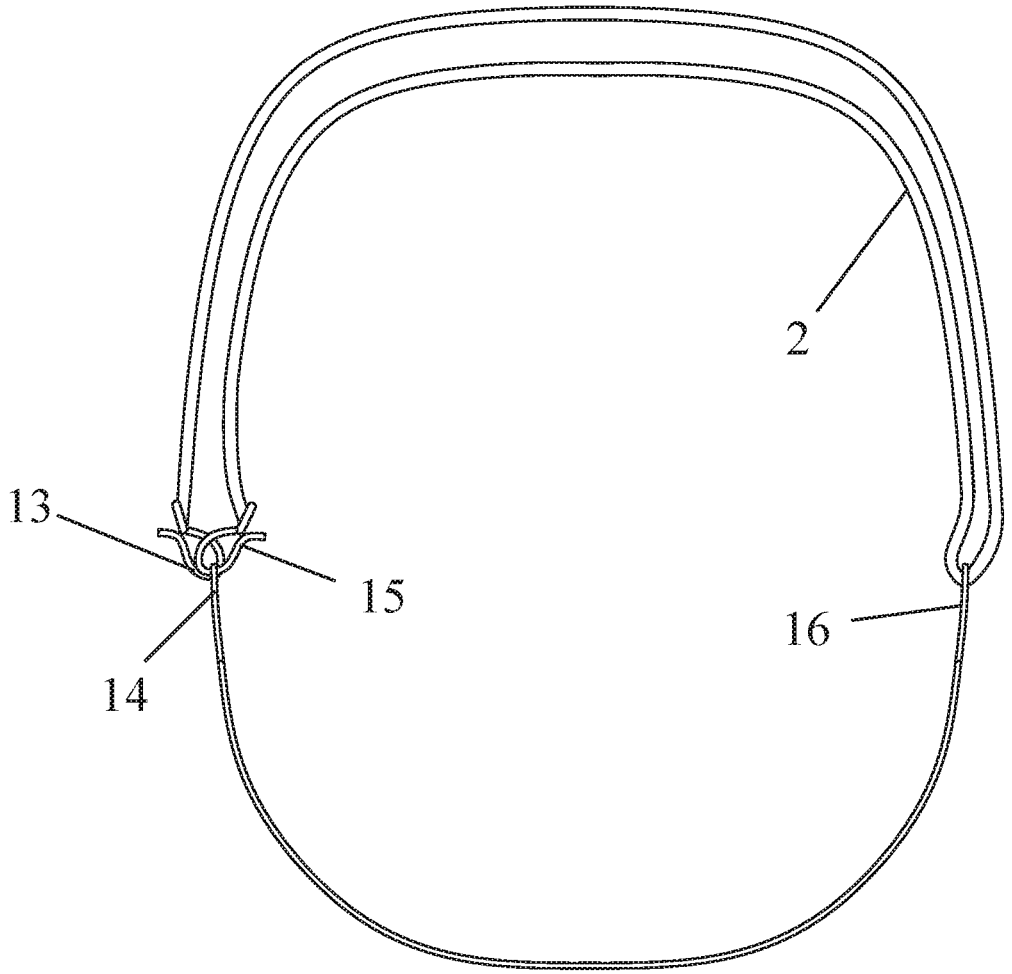
FIG. 7 shows an alternative example of top view of a surgical mask connected to a head band in accordance with embodiments of the present invention.

In another example as provided in FIG. 7, a first connector (13) may be configured to attach to a first ear loop (14) and a second connector (15) and a strap (2) may be configured to loop through a second ear loop (16) and a second connector (15) may be configured to attach to a first ear loop (14). A user may attach a first connector (13) of the connectors to a first ear loop (14) of the ear loops; loop a second connector (15) of the connectors and strap through a second ear loop (16) of the ear loops; and may attach a second connector (15) to the first ear loop (14).

Figure 8:
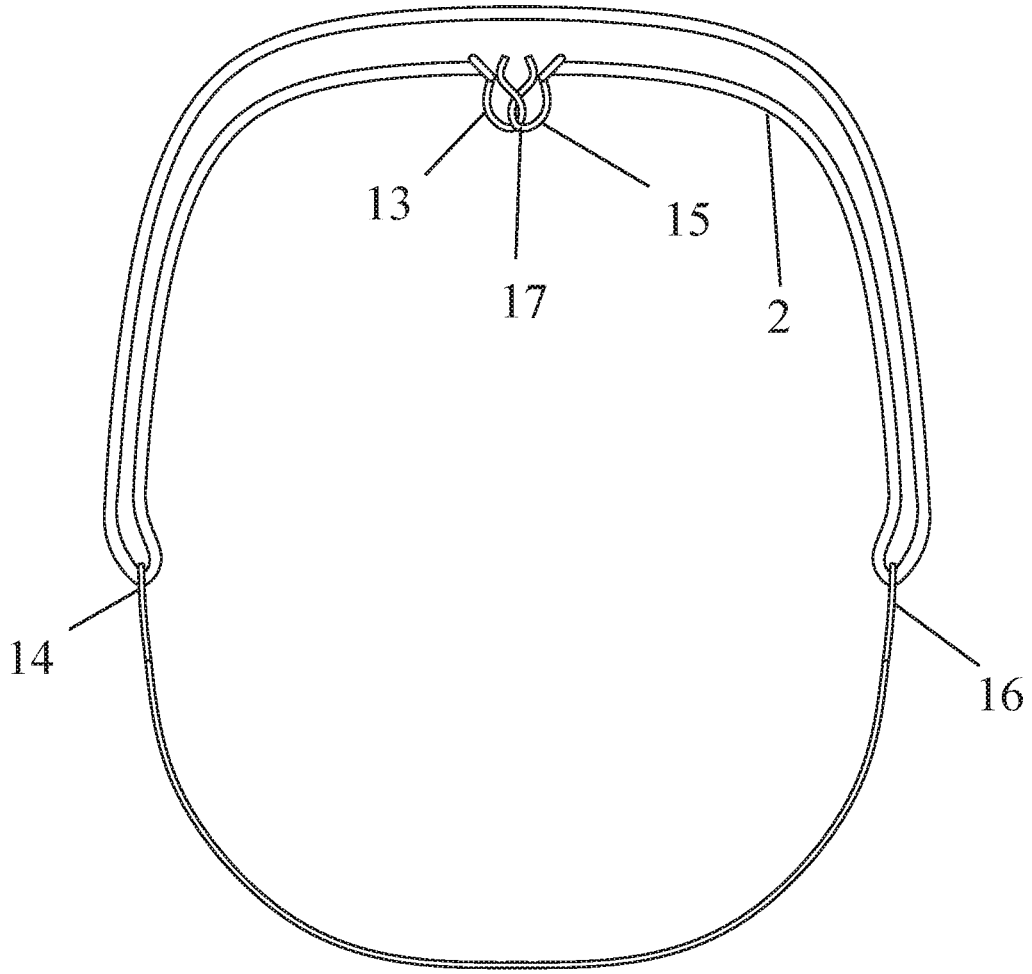
FIG. 8 shows an alternative example of top view of a surgical mask connected to a head band in accordance with embodiments of the present invention.

In yet another example, as may be understood in FIG. 8, a strap (2) may be configured to loop through each of the ear loops (14), (16) and the connectors (13), (15) may be configured to attach to each other (17). A user may loop a strap (2) through each of the ear loops (14),(16) and may attach the connectors to each other (17).

Figure 3:
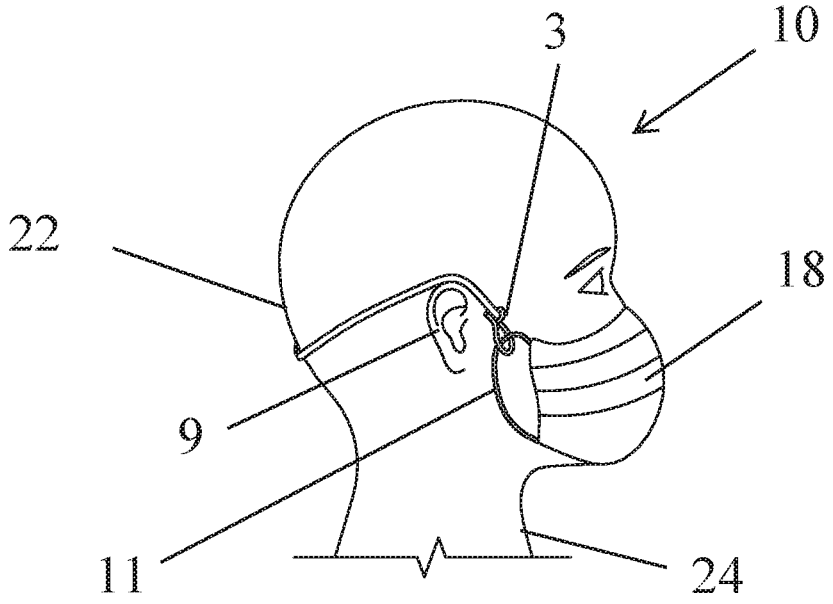
FIG. 3 shows an example of a side view of a user wearing a surgical mask connected with a head band in accordance with embodiments of the present invention.

In embodiments, a head band may be permanently affixed or may even by removably affixed to ear loops of a surgical mask. A connector may be secured or even pinched together around an ear loop by the user perhaps to form a secure position on each side of the ear loop. Once attached, the user (10) may place a surgical mask on his face (7) and over the nose and mouth of a user. A user may pull the head band over his head (8) perhaps using an "over-the-head" technique. When the mask may be worn, it may be conformable to the user perhaps because the ear loops may not be pulling down and forward on the ears. Instead, the head ban may eliminate the ear pull, perhaps by placing a head band around a back (22) of a user's head and securing the surgical mask (6) to the user's face (7) as can be seen in FIGS. 2 and 3. The head band may also be stretched during use.

For example, when a head band may be attached to a surgical mask and a surgical mask and head band may be placed on a face (7) and head (8) of a user (10), the head band may be configured to prevent the ear loops (5) from going around the ears (9) of the user such that the ear loops may avoid being placed around each ear of a user. Each of the ear loops may be located in front (11) of each ear (9) of the user or may even be located near each cheek (23) of a user (10).

A user may now may now wear the face mask more comfortably and a user may wish to removed the mask, perhaps temporarily, the mask may be taken off and allow to hang with a head band located around a user's neck (24) which may avoid adding additional tension to the ears when the mask may be used without a head band.

In some embodiments, a manufacturing process may be achieved by the same company that manufactures the face mask, perhaps avoiding a third party in this process and perhaps keeping the cost low. Embodiments of the present invention could be sold separate or together with the face masks, depending on a consumer's preference. This may be determined based on the nature of the head band being disposable or reusable. The present invention may be intended to either be disposable and discarded with the face mask when it is discarded or reusable and retained for future use when the face mask is discarded. Embodiments of the present invention may make it easy for the mask wearer to attach to the ear loops and when worn, it may greatly increase the comfort to the person.

As can be easily understood from the foregoing, the basic concepts of the present invention may be embodied in a variety of ways. It involves both hooking techniques as well as devices to accomplish the appropriate hook. In this application, the connection techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "connector" should be understood to encompass disclosure of the act of "connecting"—whether explicitly discussed or not—and, conversely, were there effectively disclosure of the act of "connecting", such a disclosure should be understood to encompass disclosure of a "connector" and even a "means for connecting." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant (s).

Thus, the applicant(s) should be understood to have support to claim and make a statement of invention to at least: i) each of the connecting devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such processes, methods, systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A method of adjusting a surgical face mask comprising the steps of:

providing the surgical face mask comprising:

a mask portion that covers a nose and mouth of a user; and two ear loops, each of said ear loops located opposite of each other on opposite sides of said mask portion;

providing a head band comprising a strap and two connectors, each connector located at each terminal end of said strap;

looping said strap through each of said two ear loops of said surgical face mask;

directly connecting said connectors to each other, creating a looped head band through said two ear loops of said surgical face mask;

placing said surgical face mask on a face of said user and over said nose and mouth of said user;

pulling said looped head band over a head of said user;

avoiding placing said ear loops around each ear of said user by situating each ear loop in a position anterior to each respective ear on a corresponding cheek;

placing said looped head band around a back of said head of said user; and securing said surgical face mask to said user's face;

removing the mask portion from the nose and mouth and removing the ear loops from their positions anterior to the ears on the cheeks to hang the surgical face mask with the head band around the user's neck.

2. The method of adjusting the surgical face mask as described in claim 1 and further comprising a step of stretching said head band.

3. The method of adjusting the surgical face mask as described in claim 1 wherein said strap is made of a material selected from a group comprising static filaments, elastic fibers, neoprene, and silicone.

4. The method of adjusting the surgical face mask as described in claim 1 wherein said two connectors are chosen from a hook, a hook and loop fastener, glue, a welded joint, an adhesive, a button, and a snap.

5. The method of adjusting the surgical face mask as described in claim 1 wherein said two connectors are made of a material chosen from plastic, metal, silicone, fabric, rubber, metal coated in silicone, metal coated in rubber, metal coated in fabric, and malleable material.

6. The method of adjusting the surgical face mask as described in claim 1 and further comprising a step of reusing said head band with a new surgical face mask.

* * * * *